US011639668B2

(12) United States Patent
Fraisse et al.

(10) Patent No.: US 11,639,668 B2
(45) Date of Patent: May 2, 2023

(54) METHOD AND CONTROL UNIT FOR CONTROLLING THE PLAY OF A HIGH-PRESSURE TURBINE

(71) Applicant: SAFRAN AIRCRAFT ENGINES, Paris (FR)

(72) Inventors: Patrice Fraisse, Moissy-Cramayel (FR); Tangi Rumon Brusq, Moissy-Cramayel (FR); Jean-Loïc Hervé Lecordix, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 111 days.

(21) Appl. No.: 16/976,218

(22) PCT Filed: Feb. 26, 2019

(86) PCT No.: PCT/FR2019/050438
§ 371 (c)(1),
(2) Date: Aug. 27, 2020

(87) PCT Pub. No.: WO2019/166734
PCT Pub. Date: Sep. 6, 2019

(65) Prior Publication Data

US 2021/0003028 A1 Jan. 7, 2021

(30) Foreign Application Priority Data

Feb. 28, 2018 (FR) ..... 1851777

(51) Int. Cl.
*F01D 11/24* (2006.01)
*F01D 25/14* (2006.01)

(52) U.S. Cl.
CPC ..... *F01D 11/24* (2013.01); *F01D 25/14* (2013.01); *F05D 2220/323* (2013.01);
(Continued)

(58) Field of Classification Search
CPC ..... F01D 11/14–24; F05D 2270/11–114
See application file for complete search history.

(56) References Cited

U.S. PATENT DOCUMENTS 5,081,830 A * 1/1992 Schwarz ..... F01D 11/24 60/782
6,626,635 B1 9/2003 Prowse et al.
(Continued)

FOREIGN PATENT DOCUMENTS

EP 1 607 584 A1 12/2005
FR 2 997 443 A1 5/2014

OTHER PUBLICATIONS

International Search Report dated Jun. 18, 2019 in PCT/FR2019/050438 filed on Feb. 26, 2019, 2 pages.
(Continued)

*Primary Examiner* — Stephanie Sebasco Cheng
(74) *Attorney, Agent, or Firm* — Oblon, McClelland, Maier & Neustadt, L.L.P.

(57) ABSTRACT

A method for controlling the clearance between the blade tips of a high-pressure turbine of a gas turbine aircraft engine and a turbine shroud, including the controlling of a valve delivering a stream of air to the turbine shroud, this method further including the following steps: the detection of a transient acceleration phase of the engine; the receiving of an item of data representative of the gas temperature at the outlet of the combustion chamber of the engine; a valve opening command, to deliver the air stream to the turbine shroud or to increase the flow rate of the delivered air stream, if the transient acceleration phase is detected and if the gas temperature at the outlet of the combustion chamber is greater than a first temperature threshold corresponding to a degraded clearance characteristic of an aged engine, this threshold being less than an operating limit temperature of the engine.

12 Claims, 4 Drawing Sheets

(52) U.S. Cl.
CPC .... *F05D 2260/30* (2013.01); *F05D 2270/301* (2013.01); *F05D 2270/303* (2013.01); *F05D 2270/44* (2013.01)

(56) References Cited

U.S. PATENT DOCUMENTS

| | | | | |
|---|---|---|---|---|
| 7,431,557 | B2 * | 10/2008 | Herron | F01D 11/24 415/127 |
| 7,584,618 | B2 * | 9/2009 | Amiot | F02C 6/08 60/782 |
| 8,296,037 | B2 * | 10/2012 | Plunkett | F01D 11/20 701/100 |
| 8,668,431 | B2 * | 3/2014 | Rog | F01D 11/24 415/139 |
| 8,996,277 | B2 * | 3/2015 | Beecroft | F02C 9/28 700/39 |
| 10,415,421 | B2 * | 9/2019 | Arnold | F01D 11/24 |
| 10,890,083 | B2 * | 1/2021 | Rowe | F01D 21/12 |
| 2005/0109016 | A1 | 5/2005 | Ullyott | |
| 2005/0276690 | A1 | 12/2005 | Amiot et al. | |

OTHER PUBLICATIONS

French Preliminary Search Report dated Oct. 26, 2018 in French Application 1851777 filed on Feb. 28, 2018, 2 pages.

* cited by examiner

METHOD AND CONTROL UNIT FOR CONTROLLING THE PLAY OF A HIGH-PRESSURE TURBINE

BACKGROUND OF THE INVENTION

The present invention relates to the general field of turbomachines for gas turbine aeronautical engines. It more precisely concerns the control of the clearance between, on the one hand, the moving blade tips of a turbine rotor and, on the other hand, a turbine shroud of an outer casing surrounding the blades.

The clearance existing between the blade tips of a turbine and the shroud that surrounds them is dependent on the differences in dimensional variation between the rotating parts (disc and blades forming the turbine rotor) and the fixed parts (outer casing including the turbine shroud it comprises). These dimensional variations are both of thermal origin (related to the temperature variations of the blades, the disc and the casing) and of mechanical origin (in particular related to the effect of the centrifugal force exerted on the turbine rotor).

To increase the performance of a turbine, it is desirable to minimize the clearance as much as possible. Additionally, when there is an increase in rating, for example when passing from a ground idle rating to a take-off rating in a turbomachine for an aeronautical engine, the centrifugal force exerted on the turbine rotor tends to bring the blade tips closer to the turbine shroud before the turbine shroud has had time to expand from the effect of the temperature increase related to the increase in rating. There is therefore a risk of contact at this operating point known as the pinch point.

It is known to employ an active control system to control the clearance of the blade tips of a turbomachine turbine. A system of this type generally operates by directing air bled off, for example at the level of a compressor and/or the turbomachine fan, onto the outer surface of the turbine shroud. Cool air sent onto the outer surface of the turbine shroud has the effect of cooling the latter and thus limiting its thermal expansion. The clearance is therefore minimized. Conversely, hot air promotes the thermal expansion of the turbine shroud, which increases the clearance and makes it possible for example to avoid contact at the aforementioned pinch point.

An active control of this kind is operated by a control unit, for example by the full authority regulation system (or FADEC) of the turbomachine. Typically, the control unit acts on a controlled-position valve to control the flow rate and/or temperature of the air directed onto the turbine shroud, as a function of a clearance setpoint and an estimate of the actual blade tip clearance.

The turbomachine also has an operating limit temperature. The operating limit temperature of the engine is defined with respect to a limit temperature of the combustion gas determined downstream of its combustion chamber, for example deduced from at least one measurement made within the high-pressure or low-pressure turbine of the engine. This temperature is commonly referred to as the "Red Line EGT". The Red Line EGT is identified during tests carried out on the ground (Block Tests) by the manufacturer, then communicated thereby. In other words, the Red Line EGT is the maximum value declared by the manufacturer, this value being certified according to the engine lifecycle (e.g. new or reconditioned engine). Once this limit is reached the engine is sent off for maintenance in order to restore a positive EGT margin. The term "EGT margin" is understood to mean the difference between the Red Line EGT certified by the manufacturer and a combustion gas temperature determined downstream of the combustion chamber of the engine.

The combustion gas temperature downstream of the combustion chamber of the engine is generally at a maximum during a phase of rapid acceleration, given the thermal response of the engine. Typically, approximately 60 seconds after an acceleration phase, the clearance between the blades of the rotor of the high-pressure turbine and the shroud surrounding them increases. The increase in this clearance manifests as an increase in the combustion gas temperature. Downstream of the combustion chamber, by way of example at the outlet of the high-pressure turbine, temperatures are measured in the order of 20 to 30K greater than a temperature of the engine in stabilized rating, the stabilized rating being obtained after a given time interval following the acceleration phase of the engine.

The temperature difference between the maximum combustion gas temperature determined during a phase of acceleration of the turbomachine and the temperature of its stabilized regime determined after this acceleration phase is currently referred to as the "Overshoot".

In practice, the more the engine ages, the more the maximum combustion gas temperature increases. The maximum combustion gas temperature therefore tends to approach the operating limit temperature of the engine (Red Line EGT) as the latter ages. This temperature degradation is generally justified, at least in part, by a degradation of the high-pressure turbine manifesting as an increase in its clearance.

In this context, taking into account the aging of the engine, it would be beneficial to keep a positive EGT margin for as long as possible in order to postpone sending the engine off for maintenance.

During an acceleration phase, the optimization of the clearance between the blades of the rotor of the high-pressure turbine and the shroud surrounding them can make it possible to reduce the Overshoot, and therefore the maximum combustion gas temperature. However, such an optimization can pose a risk of premature wear to the high-pressure turbine. By way of example, too great a reduction of the Overshoot related to a prolonged reduction of the clearance of the high-pressure turbine for a new, hot engine, or an engine that already has minimized clearance of its high-pressure turbine, can result in a pinch point between the blades and the shroud of the high-pressure turbine. Thus, the limitation of an Overshoot during a phase/transient state of the engine can pose a risk of permanent degradation of the blades of the high-pressure turbine, thus affecting the overall performance of the engine and its fuel consumption.

It would therefore be desirable to minimize the temperature Overshoot of the high-pressure turbine during a variation in the engine rating, while eliminating any risk of degradation of the blades of the high-pressure turbine.

SUBJECT AND SUMMARY OF THE INVENTION

The aim of the present invention is to remedy the aforementioned drawbacks.

For this purpose, the invention proposes a method for controlling the clearance between, on the one hand, the blade tips of a rotor of a high-pressure turbine of a gas turbine aircraft engine and, on the other hand, a turbine shroud of a casing surrounding said blades of the high-pressure turbine, the method comprising the controlling of a valve delivering a stream of directed air to said turbine shroud, this method being characterized in that it comprises the following steps:

- the detection of a transient acceleration phase of the engine on the basis of at least one parameter representative of the engine;
- the receiving of an item of data representative of the gas temperature at the outlet of the combustion chamber of the engine;
- a valve opening command, to deliver said air stream to the turbine shroud or to increase the flow rate of said delivered air stream, if the transient acceleration phase is detected and if the gas temperature at the outlet of the combustion chamber of the engine is greater than a first temperature threshold corresponding to a degraded clearance characteristic of an aged engine, the first temperature threshold being less than an operating limit temperature of the engine.

Advantageously, the method above makes it possible to adapt the control of clearance during an acceleration phase of the engine, while taking into account the residual margin existing between the operating limit temperature of the engine and the combustion gas temperature at the outlet of the combustion chamber of the engine. As explained previously, as the engine ages, the maximum combustion gas temperature of the engine increases and tends to approach the operating limit temperature of the engine (Red Line EGT). In other words, the EGT margin tends to decrease when the engine ages. The taking into account of the separation between the operating limit of the engine and the combustion gas temperature of the engine, via the first temperature threshold, therefore makes it possible to take into account the aging of the engine. Thus, the clearance setpoint of the high-pressure turbine is adapted as a function of the aging of the engine. Subsequently, the adaptation of this clearance setpoint itself influences the variation in the combustion gas temperature at the outlet of the combustion chamber of the engine, thus making it possible to reduce the Overshoot. The clearance of the high-pressure turbine as well as the Overshoot are therefore regulated in a closed loop and adaptively as a function of the aging of the engine. This method is applicable throughout the engine lifecycle. Typically an aged engine has greater clearance in its high-pressure turbine than a new engine. As a function of the aging of the engine, the method described above then makes it possible to minimize the clearance of its high-pressure turbine, via control of the valve, without risking damage to the turbine blades. The performance of the turbomachine is thus optimized throughout its lifecycle. This therefore extends the time over which a positive EGT margin is kept for the engine, which makes it possible to increase the life of the engine and postpone its being sent off for maintenance.

Preferably, in this method a higher percentage of valve opening is commanded if the combustion gas temperature temporarily exceeds the first temperature threshold.

In an exemplary embodiment of this method, said at least one parameter representative of the engine is the engine rating and the detection of a transient acceleration phase of the engine comprises the continuous determination of the engine rating and the determination of a variation in the engine rating for a predetermined time interval, the transient acceleration phase of the engine being detected during said predetermined time interval if the variation in the engine rating is greater than or equal to a variation threshold characterizing a transient acceleration phase of the engine.

In an exemplary embodiment, said at least one parameter representative of the engine is chosen from among: the rating of a low-pressure turbine of the engine, the rating of the high-pressure turbine, the angular position of an aircraft throttle lever and the item of data representative of the gas temperature at the outlet of the combustion chamber of the engine.

In an exemplary embodiment of this method, the valve is a valve of on-off type configured to switch between an open state and a closed state, the method further comprising, following the opening of the valve, a command to close the valve when the gas temperature at the outlet of the combustion chamber of the engine is less than a second temperature threshold, the second temperature threshold being less than the first temperature threshold.

In another exemplary embodiment of this method, the valve is a controlled-position valve, the method comprising a command to gradually open the valve as a function of a predefined control law taking into account a separation between the gas temperature at the outlet of the combustion chamber of the engine and the first temperature threshold.

In an exemplary embodiment of this method, the item of data representative of the gas temperature at the outlet of the combustion chamber is a temperature measurement taken at the level of the high-pressure turbine.

The invention also proposes, according to another aspect, a control unit for controlling the clearance between, on the one hand, a number of blade tips of a rotor of a high-pressure turbine of a gas turbine aircraft engine, and, on the other hand, a turbine shroud of a casing surrounding said blades of the high-pressure turbine, the control unit comprising means for controlling a valve, the valve being configured to deliver a stream of air to said shroud of the turbine, the control unit being characterized in that it comprises:

- detection means configured to detect a transient acceleration phase of the engine on the basis of at least one parameter representative of the engine;
- receiving means configured to receive an item of data representative of the gas temperature at the outlet of the combustion chamber of the engine;
- the control means being configured to command the opening of the valve to deliver said air stream to the turbine shroud, or to control an increase in the flow rate of said stream of delivered air, if the transient acceleration phase is detected and if the gas temperature at the outlet of the combustion chamber of the engine is greater than a first temperature threshold corresponding to a degraded clearance characteristic of an aged engine, the first temperature threshold being less than an operating limit temperature of the engine.

Preferably, the control means are furthermore configured to command a greater percentage of opening of the valve if the combustion gas temperature temporarily exceeds the first temperature threshold.

Advantageously, to judge the state of aging of the engine, the control unit counts a trigger number to trigger the additional valve opening command.

In an exemplary embodiment, in this control unit, said at least one parameter representative of the engine is the engine rating and the detection means are configured to:

- continuously determine the engine rating;
- determine a variation in the engine rating for a predetermined time interval;
- detect the transient acceleration phase of the engine during said predetermined time interval if the variation in the engine rating is greater than or equal to a variation threshold characterizing a transient acceleration phase of the engine.

In an exemplary embodiment, in this control unit, the valve is a valve of on-off type configured to switch between an open state and a closed state, the control means being configured to command, following the opening of the valve, the closing of the valve when the gas temperature at the outlet of the combustion chamber of the engine is less than a second temperature threshold, the second temperature threshold being less than the first temperature threshold.

In another exemplary embodiment, in this control unit, the valve is a controlled-position valve, the control means being configured to command the gradual opening of the valve as a function of a predefined control law taking into account a separation between the gas temperature at the outlet of the combustion chamber of the engine and the first temperature threshold.

The invention also proposes, according to another aspect, a gas turbine aircraft engine comprising the control unit summarized above and at least one valve for acting on an air stream directed toward the turbine shroud and wherein the valve is controlled by the control means.

BRIEF DESCRIPTION OF THE DRAWINGS

Other features and advantages of the invention will become apparent from the following description of particular embodiments of the invention, given by way of non-limiting example, with reference to the appended drawings, wherein.

DETAILED DESCRIPTION OF EMBODIMENTS

Figure 1:
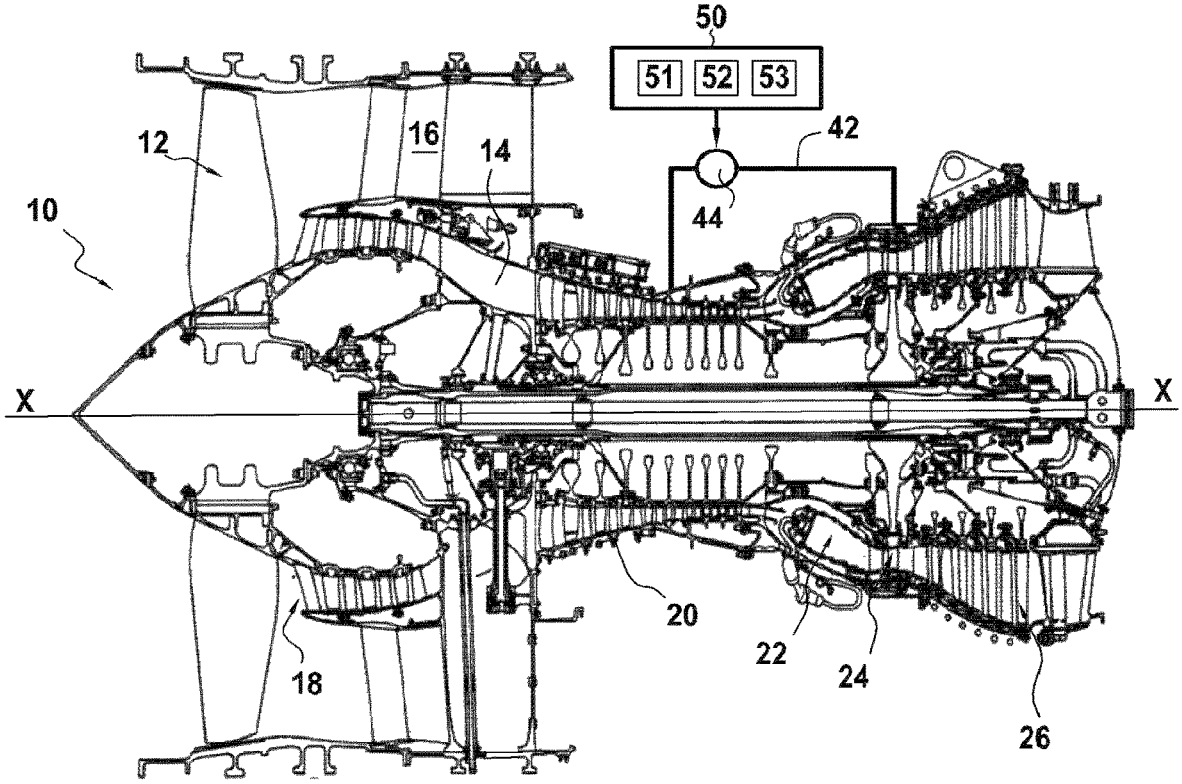
FIG. 1 is a schematic and longitudinal section view of a part of a gas turbine aircraft engine according to an embodiment of the invention.

FIG. 1 schematically represents a jet engine 10 of double-flow, twin-spool type to which the invention in particular applies. Of course, the invention is not limited to this particular type of gas turbine aircraft engine.

In a well-known manner, the jet engine 10 of longitudinal axis X-X particularly comprises a fan 12 which delivers a stream of air in a primary stream flow duct 14 and in a secondary stream flow duct 16 coaxial with the primary stream duct. From upstream to downstream in the direction of flow of the gas stream passing through it, the primary stream flow duct 14 comprises a low-pressure compressor 18, a high-pressure compressor 20, a combustion chamber 22, a high-pressure turbine 24 and a low-pressure turbine 26.

Figure 2:
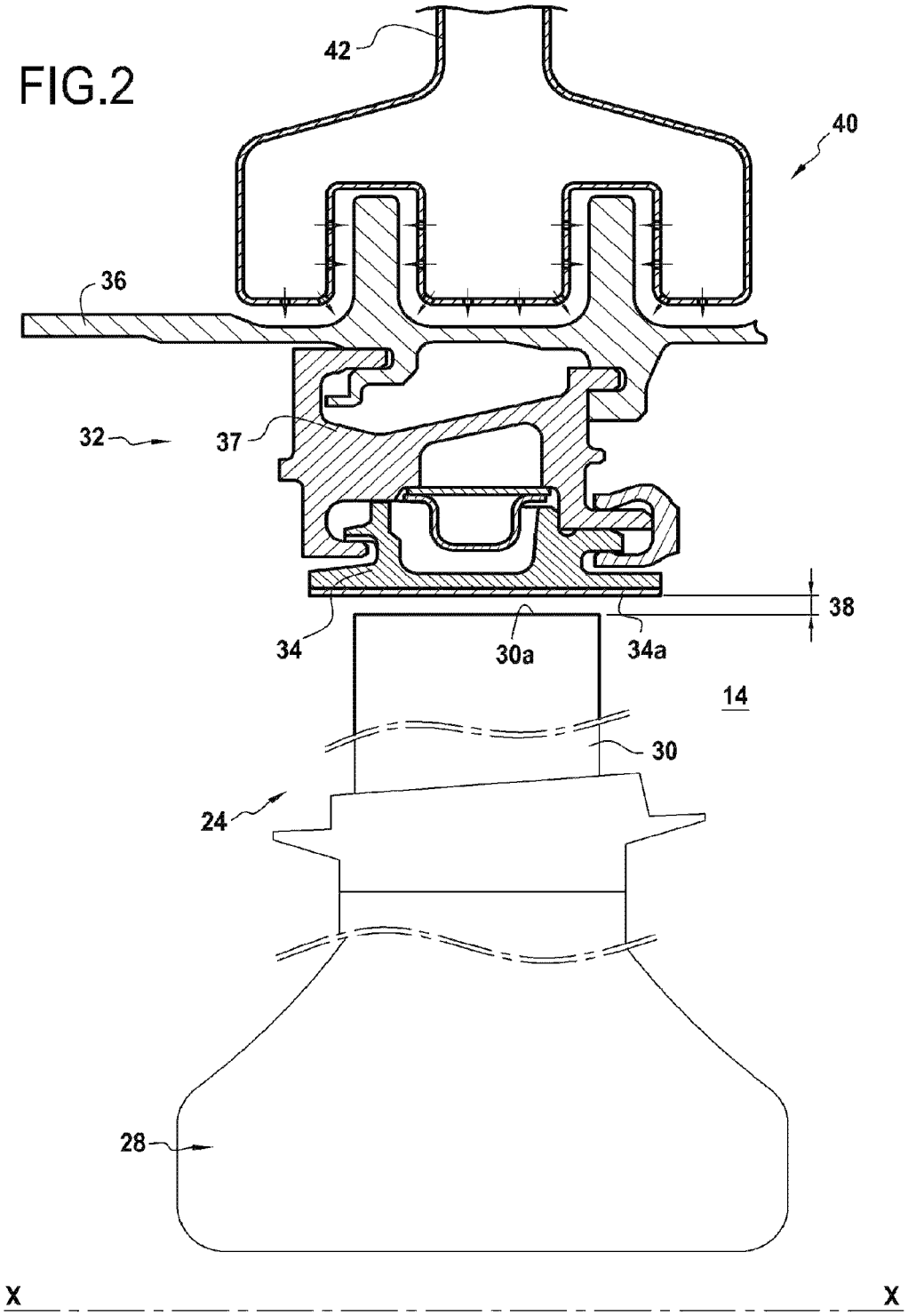
FIG. 2 is a magnified view of the engine of FIG. 1 in particular showing the high-pressure turbine of the engine.

As shown more precisely by FIG. 2, the high-pressure turbine 24 of the jet engine comprises a rotor formed by a disc 28 on which are mounted a plurality of blades 30 disposed in the primary stream flow duct 14. The rotor is surrounded by a turbine casing 32 comprising a turbine shroud 34 carried by an outer turbine casing 36 by way of attachment spacers 37.

The turbine shroud 34 can be formed by a plurality of adjacent sections or segments. On the inner side, it is provided with a layer 34*a* of abradable material and surrounds the blades 30 of the rotor, leaving a clearance 38 between itself and the tips 30*a* of the blades.

In accordance with the invention, provision is made for a system making it possible to control the clearance 38 by modifying, in a controlled manner, the inner diameter of the outer turbine casing 36. For this purpose, a control unit 50 controls the flow rate and/or the temperature of the air directed toward the outer turbine casing 36. The control unit 50 is for example the full authority regulation system (or FADEC) of the jet engine 10.

In the example shown, a control box 40 is disposed around the outer turbine casing 36. This box receives cool air by means of an air conduit 42 opening at its upstream end into the flow duct of the primary stream at one of the stages of the high-pressure compressor 20 (for example by means of a scoop known perse and not shown in the figures). The cool air circulating in the air conduct is discharged onto the outer turbine casing 36 (for example using multiple perforations on the walls of the control box 40) causing it to cool and its inside diameter to thus be reduced.

As shown in FIG. 1, a valve 44 is disposed in the air conduit 42. This valve 44 is controlled by the control unit 50.

In a first exemplary embodiment, the valve 44 can be an on-off valve able to switch between an open state and a closed state. The use of such a valve is advantageous, particularly in terms of cost, bulk, reliability and power necessary for control.

It will be understood that by controlling the valve 44 to act, on the one hand, on the opening frequency and on the other hand, on the cyclic opening/closing ratio of the valve, it is possible to obtain a variation in the average flow rate of the air directed toward the casing. Different architectures of on-off valve are well-known to those skilled in the art and will therefore not be described here. Preferably, an electrically controlled valve would be chosen control which would remain in the closed position in the absence of an electrical power supply (thus guaranteeing that the valve remains closed in the event of a control fault).

In a second exemplary embodiment, the valve 44 can be a controlled-position valve. The position of the valve 44 can be between 0%, corresponding to a closed valve, and 100%, corresponding to an open valve. When the valve 44 is open (position at 100%), the cool air is conveyed toward the outer turbine casing 36, which results in the thermal contraction of the latter and therefore a reduction in the clearance 38. When, on the contrary, the valve 44 is closed (position at 0%), the cool air is not conveyed toward the outer turbine casing 36 which is therefore heated by the primary stream. This results either in the thermal expansion of the casing 1 and an increase in the clearance 38, or at least the controlled limitation (or stopping) of the expansion of the casing 1 and the control of the clearance 38. In the intermediate positions, the outer turbine casing 36 contracts or expands and the clearance 38 increases or decreases, to a lesser extent. As will be seen later, control of the clearance 38 is used in such a way as to keep a positive EGT margin, thus making it possible to extend the lifetime of the jet engine 10.

Of course, the invention is not limited to these two examples. Thus, another example can consist in bleeding off air at two different stages of the compressor and controlling valves 44 to modulate the flow rate of each of these bleed-offs to regulate the temperature of the mixture to be directed onto the outer turbine casing 36.

We will now describe the controlling of the valve 44 by the control unit 50.

In accordance with the invention, the control unit 50 comprises:

- detection means 51 configured to detect a transient acceleration phase of the jet engine 10 over a predetermined time interval;
- receiving means 52 configured to receive at least one item of data representative of the temperature of the combustion gases coming from the combustion chamber 22 of the jet engine 10;
- control means 53 configured to control the valve 44.

The detection means 51, the receiving means 52 and the control means 53 together form a module for controlling the valve 44 incorporated into the control unit 50. This control module corresponds for example to a computer program executed by the control unit 50, to an electronic circuit of the control unit 50 (for example of programmable logic circuit type) or to a combination of an electronic circuit and a computer program.

The term "transient acceleration phase of the jet engine 10" is understood to mean a transition in rating related to an acceleration phase of the jet engine 10 occurring between two stabilized ratings of it. The transitional acceleration phase that one is seeking to detect using the detection means 51 can by way of example correspond to a transition between the ground idle rating and the stabilized flight rating, i.e. to the phase of acceleration between these two ratings. In another example, the transient acceleration phase can correspond to the phase of acceleration between any intermediate rating (e.g. half-throttle) and the flight rating.

The detection, where applicable, of a transient acceleration phase of the jet engine 10 can be done on the basis of one or more parameters representative of the jet engine 10.

A parameter representative of the jet engine 10 is by way of example its rotation rating. The detection of a transient acceleration phase of the jet engine 10 is then done on the basis of a continuous determination of its rating. The detection of the variation in the rating of the jet engine 10 by the detection means 51 then makes it possible to identify a transient acceleration phase of the jet engine 10 over a predefined period, for example chosen between 1 second and 5 minutes. During this predetermined time interval, the detection means 51 can identify a transient acceleration phase by observing the variations in rating of the jet engine 10. These variations are then compared to a setpoint characterizing a variation in rating of the jet engine 10. Thus, if during the predetermined time interval the variation in the rotation rating of the jet engine 10 is greater than or equal to a variation threshold characterizing a transient acceleration phase of the jet engine 10, the detection means 51 detect a transient acceleration phase.

In other examples, the determination of the rating of the jet engine 10, as well as the detection of a transient acceleration phase of the jet engine 10 can be done on the basis of any parameter(s) representative of the engine.

By way of example, the determination of the rotation rating of the jet engine 10 as well as the detection of a transient acceleration phase thereof can be done on the basis of one or more of the following parameters: the rating of the high-pressure turbine 24, the rating of the low-pressure turbine 26, the angular position of the aircraft throttle lever, a measured or computed combustion gas temperature at the outlet of the combustion chamber 22.

In parallel, the receiving means 52 receive at least one item of data representative of the combustion gas temperature at the outlet of the combustion chamber 22 of the jet engine 10. The item of data representative of the combustion gas is by way of example a temperature measurement taken somewhere between the outlet of the combustion chamber 22 of the jet engine and the aircraft nozzle, for example at any point of the high-pressure turbine 24 or of the low-pressure turbine 26. The receiving means 52 then obtain the temperature of the combustion gas in a known manner, directly on the basis of the representative item of data or indirectly by computation on the basis thereof. By way of example, the item of data representative of the gas temperature at the outlet of the combustion chamber 22 is a temperature measurement taken at the level of the high-pressure turbine 24, i.e. taken in or at the outlet of the latter, allowing the receiving means 52 to access the gas temperature at the outlet of the combustion chamber 22.

Figure 3:
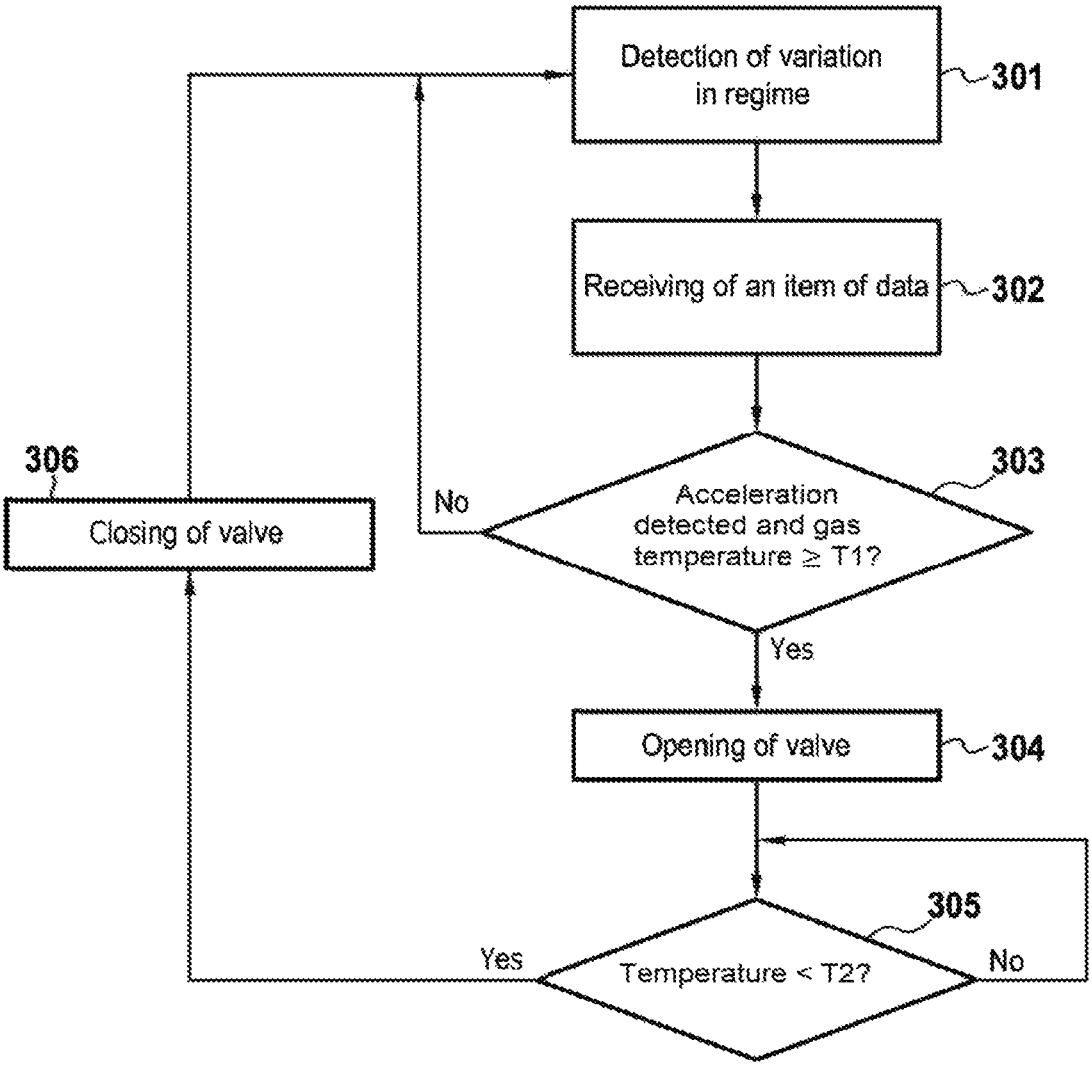
FIG. 3 is a functional diagram of a module for controlling a valve making it possible to control the blade tip clearance in the engine of FIG. 1 according to a first embodiment.
Figure 4:
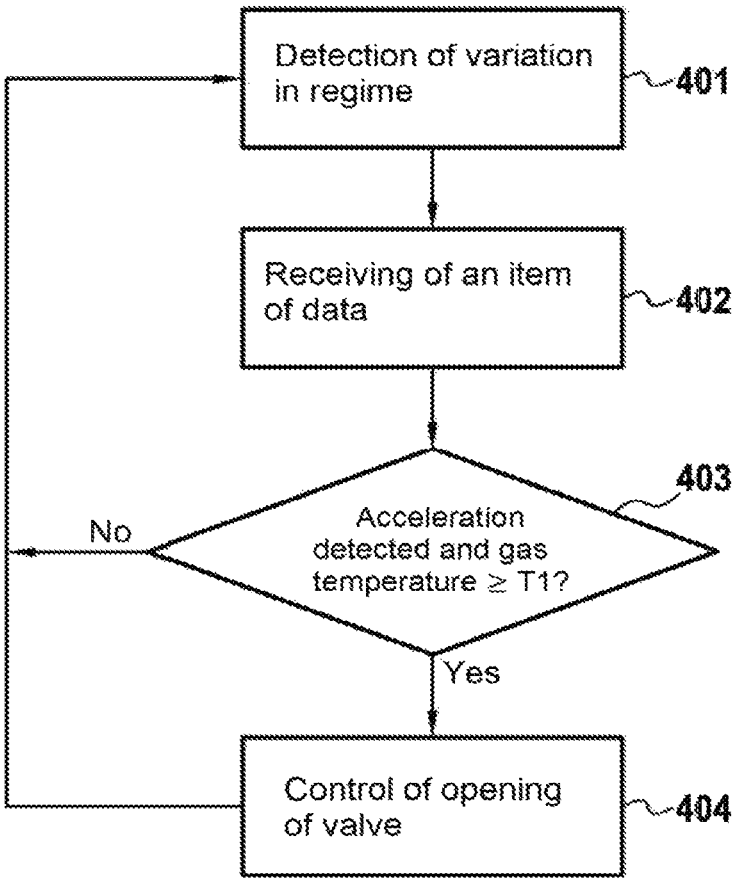
FIG. 4 is a functional diagram of a module for controlling a valve making it possible to control the blade tip clearance in the engine of FIG. 1 according to a second embodiment.

The configuration of the control means 53 depends on the type of valve 44 implemented as will be described in FIGS. 3 and 4. These figures respectively illustrate the method for controlling the valve 44, of on-off and regulated position type respectively.

The steps 301, 401 and 302, 402 are similar in these figures. These steps correspond to a step 301, 401 of detecting a variation in the rating of the jet engine 10 by the detection means 51, and to a step 302, 402 of receiving at least one item of data representative of the gas temperature at the outlet of the combustion chamber 22 of the engine by the receiving means 52. It is understood that the order of the steps illustrated in these figures is given by way of illustration, these steps being able to be done in parallel in a non-illustrated example.

The control unit 50 is configured to identify from the detection means 51 and receiving means 52 any occurrence of a situation for which:

- a transient acceleration phase of the jet engine 10 is detected, and
- the temperature of the combustion gas at the outlet of the combustion chamber (22) of the engine (10) is greater than a first temperature threshold T1.

The first temperature threshold T1 is chosen beforehand to be less than the Red Line EGT characterizing the operating limit temperature of the jet engine 10, such as to keep a positive EGT margin (difference between the Red Line EGT and the combustion gas temperature) if the combustion gas temperature of the jet engine 10 reaches the temperature threshold T1. The temperature threshold T1 is by way of example defined to be lower by 1 to 10° C. than the Red Line EGT. This temperature threshold T1 thus constitutes a protection threshold of the Red Line EGT, the reaching of this threshold parallel to a detection of a transient acceleration phase of the jet engine 10 then manifesting as an Overshoot situation for an aged engine or an engine exhibiting degraded performance.

Moreover, the temperature threshold T1 is chosen with regard to the state of health of the jet engine 10, the temperature value T1 only being meant to be reached by the combustion gas for an aged engine, for example exhibiting a degraded clearance 38. Specifically, as explained previously, the more an engine ages, the more the maximum temperature of its combustion gas increases and tends to approach the Red Line EGT. Conversely, a jet engine which is new or just out of maintenance is not subject to the risk of the gas temperature at the outlet of the combustion chamber approaching the temperature T1, still less the Red Line EGT. The identification by the control unit 50 of a situation for which a transient acceleration phase of the jet engine 10 is detected and for which the combustion gas temperature is greater than the temperature threshold T1 can therefore only occur for an engine that is aged and/or exhibiting degraded performance.

After each step 301, 302, 401, 402 the control unit 50 attempts to detect (steps 303, 403) any occurrence of the aforementioned situation. The step 303 can, by way of example, be carried out by the control means 53 or by other dedicated detection means.

If the occurrence of such a situation is not identified, the control unit 50 deduces the non-occurrence of an Overshoot of the combustion gas temperature at the outlet of the combustion chamber 22 which might run the risk of approaching the Red Line EGT. The steps 301, 302, 401, 402 are then executed again.

Conversely, if the aforementioned situation is detected, the control unit 50 deduces a situation of Overshoot of the combustion gas temperature that potentially runs the risk of approaching the Red Line EGT. The control unit 50 then seeks to minimize the Overshoot by optimizing the clearance 38 of the high-pressure turbine 24. Specifically, in the absence of optimization of the clearance 38, an Overshoot situation for an aged or degraded engine would run the risk of reducing its EGT margin and therefore its lifetime before it is sent off for maintenance. The optimization of the clearance 38 then has the aim of keeping a positive EGT margin for as long as possible.

When the valve 44 is of on-off type (FIG. 3) the control means 53 are then configured to command an opening (step 304) of the valve 44 such as to deliver a stream of air to the turbine shroud 34 and thus reduce the clearance 38 of the high-pressure turbine 24. The reduction of the clearance 38 makes it possible to optimize the performance of the high-pressure turbine 24, causing a reduction in the combustion gas temperature at the outlet of the combustion chamber 22. The combustion gas temperature is then periodically compared (step 305) to a second temperature threshold T2 chosen as equal to or less than the first temperature threshold T1 to avoid oscillation effects. As long as the combustion gas temperature remains greater than the second temperature threshold T2, the valve 44 is kept open. When the combustion gas temperature is detected as less than the second temperature threshold T2, the control means 53 command (step 306) the closing of the valve 44.

When the valve 44 is of regulated position type, the control means 53 are configured to control (step 404) the percentage of opening of the valve 44 as a function of the separation between the current combustion gas temperature and the first temperature threshold T1. In other words, the opening of the valve 44 is done gradually as a function of a control law previously stored in the control means 53, this law taking into account the separation between the combustion gas temperature at the outlet of the combustion chamber 22 and the first temperature threshold T1. The control means 53 are by way of example configured to command a greater percentage of opening of the valve 44 (resulting from an over-setpoint value) and therefore an increase in the stream of air delivered to the turbine shroud 34, if the combustion gas temperature temporarily exceeds the first temperature threshold T1. Thus, the clearance 38 of the high-pressure turbine 24 is once again optimized, subsequently causing the reduction of the combustion gas and therefore of the Overshoot. In other words, when the temperature threshold T1 is reached, a closing clearance over-setpoint value incurring an additional valve opening (of up to 200%) with respect to an open valve position (at 100%) is triggered.

Thus, the controlling of a valve 44 of on-off type or with regulated position as described above makes it possible to keep a positive EGT margin while reducing the combustion gas temperature.

The embodiments described above have the following advantages. The controlling of the clearance 38 of the high-pressure turbine 24 during an acceleration phase of the engine 10 takes into account the residual margin existing between the Red Line EGT and the combustion gas temperature at the outlet of the combustion chamber 22. The taking into account of this margin is made possible by the comparison of the combustion gas temperature with the first temperature threshold T1, chosen with respect to the Red Line EGT as protection threshold.

As explained in the introduction, as the high-pressure turbine 24 ages, the maximum combustion gas temperature tends to gradually approach the Red Line EGT. The taking into account of the separation between the Red Line EGT and the combustion gas temperature, via the temperature T1, therefore makes it possible to take into account the aging of the engine 10 of the jet engine. The exceeding of the temperature T1 by the combustion gas in particular indicates the aging or degradation of the performance of the jet engine 10 requiring a reduction of its Overshoot in order to limit any risk of approaching the Red Line EGT.

The setpoint of the clearance 38 of the high-pressure turbine 24 is then adapted by the control means 53 as a function of the aging of the engine. The adapting of this clearance setpoint itself influences the variation of the combustion gas temperature of the combustion chamber 22 and makes it possible to reduce the Overshoot in the temperature of the reactor 10.

In the same way, the trigger number of the over-setpoint value giving rise to a greater percentage of opening of the valve can be counted and stored in the control unit in order to be made use of later in maintenance to judge the state of aging of the engine.

The clearance 38 of the high-pressure turbine 24 as well as the Overshoot are therefore regulated in a closed loop and adaptively as a function of the aging of the engine, and this occurs throughout the lifecycle of the jet engine 10. Typically the high-pressure turbine 24 of an aged engine has more significant clearance than a new engine. The method described above therefore makes it possible to minimize the clearance 38 of the high-pressure turbine 24 as a function of the aging of the jet engine 10, via the controlling of the valve 44, without risking damage to the blades of the turbine. The performance of the jet engine 10 is therefore optimized throughout its lifecycle. The EGT margin is in particular kept positive for as long as possible, extending the lifetime of the jet engine 10 before it is sent off for any maintenance.

The invention claimed is:

1. A method for controlling a clearance between blade tips of a rotor of a high-pressure turbine of an aged gas turbine aircraft engine and a turbine shroud of a casing surrounding said blade tips of the high-pressure turbine, the method comprising:

providing a valve which selectively delivers a stream of directed air to said turbine shroud;

determining a setpoint of the clearance as a function of a state of aging of the aged gas turbine aircraft engine;

determining a first temperature threshold corresponding to a degraded clearance of the aged gas turbine aircraft engine based on the setpoint of the clearance;

detecting that the aged gas turbine aircraft engine is operating at a transient acceleration phase based on at least one parameter representative of the aged gas turbine aircraft engine;

receiving an item of data representative of a gas temperature at an outlet of a combustion chamber of the aged gas turbine aircraft engine;

determining the gas temperature at the outlet of the combustion chamber of the aged gas turbine aircraft engine based on the received item of data, comparing the determined gas temperature at the outlet of the combustion chamber of the aged gas turbine aircraft engine to the first temperature threshold corresponding to the degraded clearance of the aged gas turbine aircraft engine; and when it is detected that the aged gas turbine aircraft engine is operating at the transient acceleration phase and the determined gas temperature at the outlet of the combustion chamber of the aged gas turbine aircraft engine is greater than the first temperature threshold, controlling the valve to open from a closed position to deliver the stream of directed air to the turbine shroud, wherein the first temperature threshold is less than an operating limit temperature of a gas turbine aircraft engine that is not aged.

2. The control method as claimed in claim 1, wherein said at least one parameter representative of the aged gas turbine aircraft engine is an engine rating and wherein the detecting of the transient acceleration phase of the aged gas turbine aircraft engine comprises continuous determination of the engine rating and determination of a variation in the engine rating for a predetermined time interval, the transient acceleration phase of the aged gas turbine aircraft engine being detected during said predetermined time interval when the variation in the engine rating is greater than or equal to a variation threshold characterizing the transient acceleration phase of the aged gas turbine aircraft engine.

3. The control method as claimed in claim 1, wherein said at least one parameter representative of the aged gas turbine aircraft engine is chosen from among: a rating of a low-pressure turbine of the aged gas turbine aircraft engine, a rating of the high-pressure turbine, an angular position of an aircraft throttle lever and the item of data representative of the gas temperature at the outlet of the combustion chamber of the aged gas turbine aircraft engine.

4. The control method as claimed in claim 1, wherein the valve is a valve of on-off type configured to switch between an open state and a closed state, and the method further comprises, following the opening of the valve, controlling the valve to close when the gas temperature at the outlet of the combustion chamber of the aged gas turbine aircraft engine is less than a second temperature threshold, the second temperature threshold being less than the first temperature threshold.

5. The control method as claimed in claim 1, wherein the valve is a controlled-position valve, and the method further comprises controlling the valve to gradually open as a function of a predefined control law taking into account a separation between the gas temperature at the outlet of the combustion chamber of the aged gas turbine aircraft engine and the first temperature threshold.

6. The control method as claimed in claim 1, wherein the item of data representative of the gas temperature at the outlet of the combustion chamber is a temperature measurement taken at a level of the high-pressure turbine.

7. A control unit for controlling a clearance between blade tips of a rotor of a high-pressure turbine of an aged gas turbine aircraft engine and a turbine shroud of a casing surrounding said blade tips of the high-pressure turbine, the control unit comprising:

circuitry configured to determine a setpoint of the clearance as a function of a state of aging of the aged gas turbine aircraft engine, determine a first temperature threshold corresponding to a degraded clearance of the aged gas turbine aircraft engine based on the setpoint of the clearance, detect that the aged gas turbine aircraft engine is operating at a transient acceleration phase based on at least one parameter representative of the aged gas turbine aircraft engine, receive an item of data representative of a gas temperature at an outlet of a combustion chamber of the aged gas turbine aircraft engine, determine the gas temperature at the outlet of the combustion chamber of the aged gas turbine aircraft engine based on the received item of data, compare the determined gas temperature at the outlet of the combustion chamber of the aged gas turbine aircraft engine to the first temperature threshold corresponding to the degraded clearance of the aged gas turbine aircraft engine, and when it is detected that the aged gas turbine aircraft engine is operating at the transient acceleration phase and the determined gas temperature at the outlet of the combustion chamber of the aged gas turbine aircraft engine is greater than the first temperature threshold, control a valve to open from a closed position to deliver a stream of air to the turbine shroud, wherein the first temperature threshold being is less than an operating limit temperature of a gas turbine aircraft engine that is not aged.

8. The control unit as claimed in claim 7, wherein, the state of aging of the aged gas turbine aircraft engine is determined based on a number of command the opening of times the valve has been controlled to be opened.

9. The control unit as claimed in claim 7, wherein said at least one parameter representative of the aged gas turbine aircraft engine is an engine rating and wherein the circuitry is configured to: continuously determine the engine rating; determine a variation in the engine rating for a predetermined time interval; detect the transient acceleration phase of the aged gas turbine aircraft engine during said predetermined time interval when the variation in the engine rating is greater than or equal to a variation threshold characterizing the transient acceleration phase of the aged gas turbine aircraft engine.

10. The control unit as claimed in claim 7, wherein the valve is a valve of on-off type configured to switch between an open state and a closed state, and the circuitry is configured to control, following the opening of the valve, the valve to close when the gas temperature at the outlet of the combustion chamber of the aged gas turbine aircraft engine is less than a second temperature threshold, the second temperature threshold being less than the first temperature threshold.

11. The control unit as claimed in claim 7, wherein the valve is a controlled-position valve, and the circuitry is configured to control the valve to gradually open as a function of a predefined control law taking into account a separation between the gas temperature at the outlet of the combustion chamber of the aged gas turbine aircraft engine and the first temperature threshold.

12. A gas turbine aircraft engine comprising:

a control unit configured to control a clearance between blade tips of a rotor of a high-pressure turbine of the gas turbine aircraft engine and a turbine shroud of a casing surrounding said blade tips of the high-pressure turbine; and a valve controlled by the control unit, wherein the gas turbine aircraft engine is aged, wherein the control unit comprises:

circuitry configured to determine a setpoint of the clearance as a function of a state of aging of the gas turbine aircraft engine, determine a first temperature threshold corresponding to a degraded clearance of the gas turbine aircraft engine based on the setpoint of the clearance, detect that the gas turbine aircraft engine is operating at a transient acceleration phase based on at least one parameter representative of the gas turbine aircraft engine, receive an item of data representative of a gas temperature at an outlet of a combustion chamber of the gas turbine aircraft engine, determine the gas temperature at the outlet of the combustion chamber of the gas turbine aircraft engine based on the received item of data, compare the determined gas temperature at the outlet of the combustion chamber of the gas turbine aircraft engine to the first temperature threshold corresponding to the degraded clearance of the gas turbine aircraft engine, and when it is detected that the gas turbine aircraft engine is operating at the transient acceleration phase and the determined gas temperature at the outlet of the combustion chamber of the gas turbine aircraft engine is greater than the first temperature threshold, control the valve to open from a closed position to deliver a stream of air to the turbine shroud, and wherein the first temperature threshold is less than an operating limit temperature of a gas turbine aircraft engine that is not aged.

* * * * *